United States Patent [19]

Novacek

[11] Patent Number: 4,722,668

[45] Date of Patent: Feb. 2, 1988

[54] DEVICE FOR DAMPING BLADE VIBRATIONS IN TURBO-MACHINES

[75] Inventor: Peter Novacek, Gebenstorf, Switzerland

[73] Assignee: BBC Brown, Boveri & Company, Limited, Baden, Switzerland

[21] Appl. No.: 898,338

[22] Filed: Aug. 20, 1986

[30] Foreign Application Priority Data

Aug. 31, 1985 [CH] Switzerland ..... 3730/85

[51] Int. Cl.[4] ..... F01D 5/20

[52] U.S. Cl. ..... 416/190; 416/3; 416/191; 416/196 R; 416/500

[58] Field of Search ..... 416/3, 190, 191, 195, 416/196 R, 500; 188/267

[56] References Cited

U.S. PATENT DOCUMENTS

| | | | |
|---|---|---|---|
| 2,198,784 | 4/1940 | Mikina | 416/196 R |
| 2,430,140 | 11/1947 | Phelan et al. | 416/191 X |
| 2,906,899 | 9/1959 | Geneslay | 188/267 X |
| 2,942,843 | 6/1960 | Sampson | 416/190 |
| 3,185,441 | 5/1965 | Reuter | 416/190 X |
| 3,576,377 | 4/1971 | Beanland et al. | 416/191 |
| 3,612,718 | 10/1971 | Palfreyman et al. | 416/190 X |
| 3,752,599 | 8/1973 | Pace | 416/190 |
| 4,200,003 | 4/1980 | Miller | 416/500 X |
| 4,257,743 | 3/1981 | Fujii | 416/500 X |
| 4,502,652 | 3/1985 | Breitbach | 188/267 X |

FOREIGN PATENT DOCUMENTS

| | | | |
|---|---|---|---|
| 1299004 | 7/1969 | Fed. Rep. of Germany . | |
| 1374917 | 8/1964 | France | 416/191 |
| 2329845 | 5/1977 | France . | |
| 92007 | 8/1978 | Japan | 416/196 R |
| 147940 | 11/1981 | Japan | 188/267 |
| 165777 | 12/1981 | Japan | 416/3 |
| 38602 | 3/1982 | Japan | 416/500 |
| 1503453 | 3/1978 | United Kingdom | 416/191 |

*Primary Examiner*—Everette A. Powell, Jr.

*Attorney, Agent, or Firm*—Burns, Doane, Swecker & Mathis

[57] ABSTRACT

In order to damp blade vibrations, the shroud plates of the blades are equipped with magnet inserts.

9 Claims, 5 Drawing Figures

DEVICE FOR DAMPING BLADE VIBRATIONS IN TURBO-MACHINES

BACKGROUND OF THE INVENTION

1. Field of the Invention

The invention relates to a device for damping blade vibrations in turbo-machines.

2. Related Art

In turbo-machines, the rotating blades are excited, among other things, by irregular inlet flow. This exciting force often causes inadmissible alternating stresses in the blades. In order to combat these dangerous vibrations, an obvious method is to thicken the blade profile. This thickening does, however, cause a substantial deterioration in efficiency and it is therefore preferable to avoid this method in practice.

An arrangement which is frequently used, and has been in use for a long time, for combating the vibrations occurring, consists in connecting the blade aerofoils together in groups within a blading row by means of a damping wire.

This conventional arrangement does, however, have the following disadvantages:

- The damping wire within the flow passage causes a deterioration in the efficiency of the turbo-machine.
- The damping wire is subjected to severe loads due to bending stresses and the temperature of the medium.
- The damping wire is subject to corrosion and erosion.

The solution passage using damping wires outside the flow passage may be considered as the most recent innovation and this arrangement has been partially described in the ASME publication 81-DET-136. This type of design permits relative movement between the wire and the blades. Since the forces on the damping wire balance each other out due to the coupling of several blades, however, the friction is not fully utilised. The wire usually behaves excitation orders under control. In order to overcome these obvious difficulties, an attempt is made in the publication above mentioned to replace the damping wire with small damping pieces anchored to the rotor disk. However, such a solution cannot be accommodated in a practical design for space reasons.

Where the blades are designed with shrouds, the latter are used for damping, the flanks of the shroud plates being machined in such a way that they form common contact surfaces of various shapes. These shroud plate structures do, however, have various disadvantages:

- Expensive machining and treatment of the contact surfaces.
- Expensive assembly.
- Varying contact surface forces depending on the operating condition.
- Mechanical wear of the contact surfaces so that the desired damping continually deteriorates.

OBJECTS AND SUMMARY OF THE INVENTION

The invention is intended to provide a remedy for the above disadvantages. The objective of the invention, is based on the creation of a device of the type mentioned initially, in which an optimum damping effect with respect to blade vibrations of the most varied excitation orders can be achieved by the inclusion of simple auxiliary means.

The essential advantages of the invention may be seen in that magnets can be integrated at any location in the blades - independently of their geometrical shape. If the blades are designed with shroud plates at their tips, the inclusion of magnets there is particularly versatile, not only as far as the location is concerned, but also with respect to the polarity direction of neighbouring magnets.

Using the drawing, examples of the invention are presented in a simplified manner and described in more detail below. Any elements not essential to direct understanding of the invention are omitted. The same elements are provided with the same reference numbers in the figures.

DETAILED DESCRIPTION OF THE PREFERRED EMBODIMENTS

Figure 1:
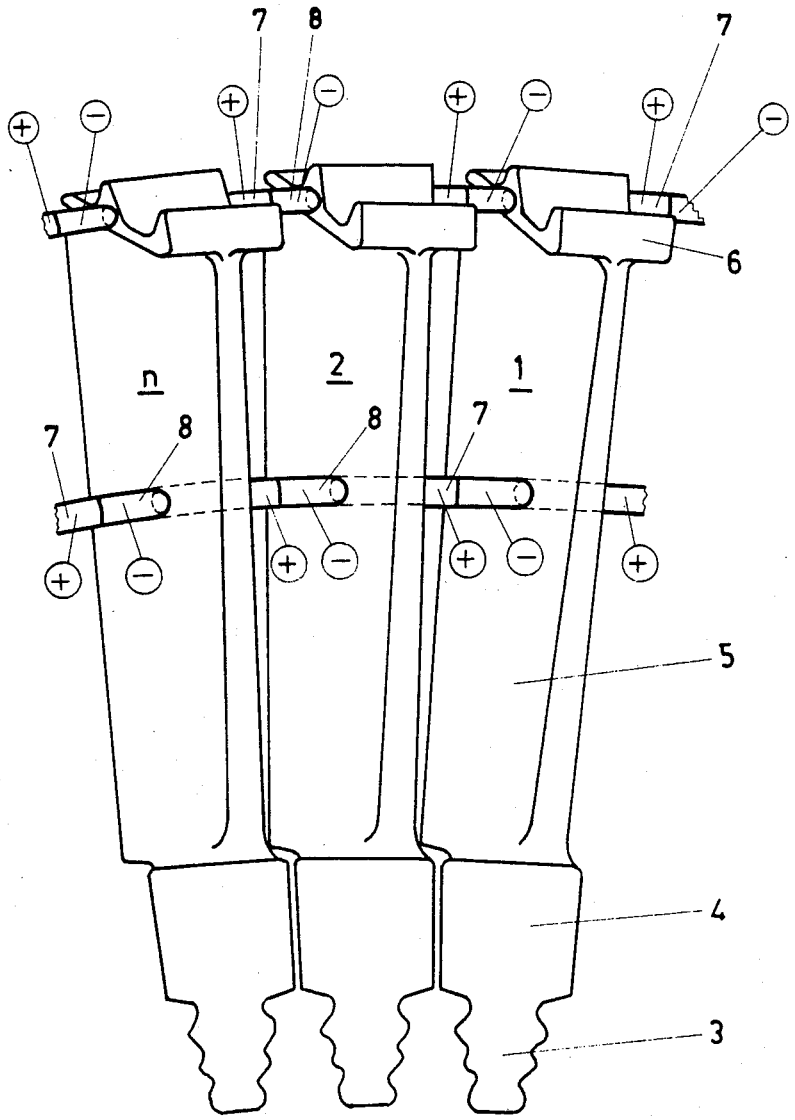
FIG. 1 is a partial view of a blading row with magnets installed.

FIG. 1 shows individual blades 1, 2, n of a blading row in the way in which they are generally arranged on a rotor disk that is, not shown in this drawing. The blades 1, 2, n themselves consist of a blade root 3, a transition part 4, a blade aerofoil 5 and a shroud plate 6. the shroud plate configuration shown here is provided in cases where slim blade aerofoils 5 are used. The main objective is to improve the efficiency. The shroud plate 6 bridges the intermediate space between the ends of the blade aerofoil 5 and the stator, which is again not shown, so that the varying thermal expansions of the rotor aerofoil 5 in the radial direction between the inlet flow and outlet flow sides of the blades, 1, 2, n no longer have any relevant effect on the gap dimensions of the intermediate space mentioned. The shroud plate 6 is also designed in such a way that it engages in a labryinth manner in the stator, so that the flow losses at this location can be minimized. Such shroud plates 6 are extremely suitable for accepting magnets 7, 8 which bridge over the individually shaped intermediate space of two neighbouring blades. The magnets 7, 8 used in this case are of a circular type of design, although other geometrical shapes can be used. The parts of the magnet protruding from the shroud plate 6 have an alternating polarity ⊕/⊖ in each case relative to the other neighbouring piece so that the individual plates 6 adhere together by means of the attraction force between the individual paired magnets 7, 8. A further intermediate stage, preferably formed by similar magnets 7, 8, is provided at approximately half blade height. This arrangement should be considered only in the case of weak blades because it involves flow losses. The intermediate stage in the region of the penetration of the magnet 8 through the blades 1, 2 can, of course, be thickened.

Figure 2:
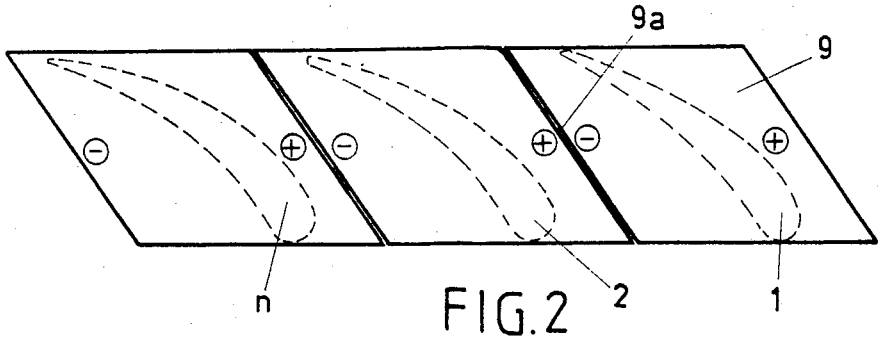
FIG. 2 is a plan view of a shroud plate design.

FIG. 2 shows a plan view on a shroud plate design in which at least the opposite end surfaces 9a of the shroud plates 9 are magnetic. The attraction force available in this case is particularly large. Such a type of design is therefore preferably used in the case of blades having a strong tendency to vibrate. In this case, however, the attraction force is only available to its full extent if the required manufacturing accuracy of the blades, in general, and of the shroud plates 9, in particular, is exactly maintained.

Figure 3:
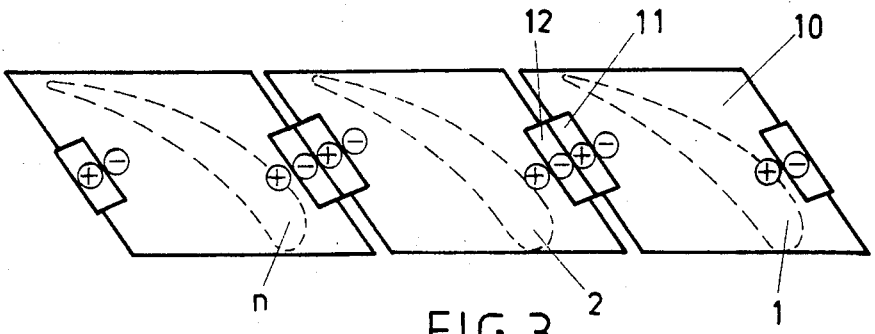
FIG. 3 is a view of a further shroud plate design with magnets installed.

In contrast, the manufacturing accuracy is not such a critical feature in the shroud plates 10 shown in FIG. 3. The individual shroud plates 10 carry manget insers 11, 12 which alone are in mutual contact. The shroud plates 10 are also set back in this region. Arrangements can be made so that the individual magnet inserts 11, 12 can be adjusted so that they are only positioned after the assembly of the blades 1, 2, n.

Figure 4:
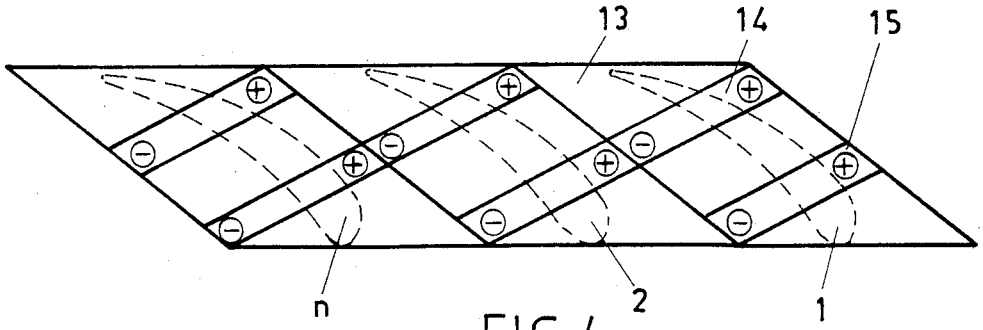
FIG. 4 is a view of a further shroud plate design with a further variant of a magnet installation.

The embodiment in FIG. 4 pursues similar objectives. Here again, the individual magnet inserts 14, 15 can be adjusted relative to one another in such a way that their magnetic end pieces butt together. The rhomboid shape of the shroud plates 13 offers advantages during the assembly of the blades 1, 2, n. Since the alignment planes of the shroud plate flanks agree with those of the root of the blade, the blades 1, 2, n can be inserted into the rotor disk without subsequent alignment.

In all the preceding examples, it is possible to extend the function of the design shapes described by the following means:

The magnet forces can be combined with other prestressing forces. Pretorsion of the blades 1, 2, n before their insertion can, for example, be considered.

The magnet inserts include the blades of a row in groups of, for example, 5–7 units. The direction of polarity of the magnets can also be alternated in groups. The resulting detuning effect can be additionally increased by varying the strength of the magnets from group to group or in the peripheral direction.

Blades equipped with magnets can be alternated with mechanically rigidly connected blades. This configuration is also intended to increase the detuning effect.

Electro-magnets can be provided instead of permanent magnets. Their control is preferably effected from outside, inductively or via sliprings.

Figure 5:
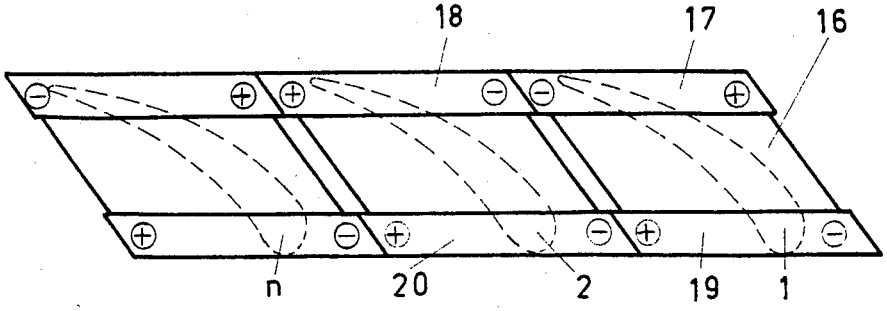
FIG. 5 is a view of a further shroud plate design with a further variant of a magnet installation.

The embodiment shown in FIG. 5 features the fact that the shroud plates 16 are each equipped with two magnet sets 17, 19 and 18, 20 respectively at their edge zones. Whereas, in the region of the blade inlet flow, the magnet sets 19, 20 are arranged in the conventional polarity direction ⊕/⊖, the other edge zone has magnet sets 17, 18 in which similar poles ⊕/⊕ or ⊖/⊖ butt together. This arrangement also permits peripheral bracing which, in combination with the opposite action of the direction of the magnet forces on the other side of the shroud plate 16, provides good elasticity against shock type occurrence of vibrations.

Similar polarity ⊕/⊕ and/or ⊖/⊖ can also, of course, be provided in the case of all the previously mentioned examples.

If vibration forces cause the shroud plates to lift, the magnet forces contribute to the reduction of the vibration by their damping capability.

The technique described can be applied to guide vanes and rotor blades.

What is claimed is:

1. A device for damping blade vibrations in blades of turbomachines, comprising a plurality of magnets, at least one of said magnets being mounted in each of the blades, said magnets being located in the blades such that the magnets of neighboring blades interact with each other to reduce vibration.

2. The device as claimed in claim 1, wherein the magnets are integrated in shroud plates of the blades.

3. The device as claimed in claim 1, wherein the polarity of neighbouring magnets can be in any direction.

4. A device for damping vibrations in blades of a turbomachine, comprising:

at least one magnet mounted to each blade, said magnets being located such that a positive region of each magnet contacts a negative region of a magnet mounted to an adjacent blade.

5. The device as claimed in claim 4, wherein said blades include shroud plates, said magnets being mounted to the shroud plates.

6. The device as claimed in claim 5, wherein said magnets are mounted in a region of blade inlet flow, and further comprising additional magnets mounted to the other side of the shroud plates, said additional magnets being arranged such that the polarity of adjacent magnets causes the adjacent magnets to repel one another.

7. The device as claimed in claim 4, wherein the magnets are integrated into opposite end surfaces of the shroud plate.

8. The device as claimed in claim 5, wherein the magnets extend from the shroud plates such that the magnets contact each other.

9. The device as claimed in claim 5, wherein the magnets are arranged relative to one another such that their end pieces butt together.

* * * * *